US008353409B2

(12) United States Patent
Murayama et al.

(10) Patent No.: US 8,353,409 B2
(45) Date of Patent: Jan. 15, 2013

(54) METHOD OF DEWATERING GAS HYDRATE AND APPARATUS THEREFOR

(75) Inventors: Tetsuro Murayama, Ichihara (JP); Kiyoshi Horiguchi, Ichihara (JP); Takashi Arai, Ichihara (JP); Toru Iwasaki, Ichihara (JP); Hidenori Moriya, Ichihara (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 672 days.

(21) Appl. No.: 12/450,447

(22) PCT Filed: Mar. 25, 2008

(86) PCT No.: PCT/JP2008/055487

§ 371 (c)(1),
(2), (4) Date: Sep. 25, 2009

(87) PCT Pub. No.: WO2008/120605

PCT Pub. Date: Oct. 9, 2008

(65) Prior Publication Data

US 2010/0089834 A1 Apr. 15, 2010

(30) Foreign Application Priority Data

Mar. 30, 2007 (JP) ..... 2007-093991

(51) Int. Cl.

| | |
|---|---|
| ***B01D 29/35*** | (2006.01) |
| ***B01D 29/37*** | (2006.01) |
| ***B01D 29/60*** | (2006.01) |
| ***B01D 29/88*** | (2006.01) |
| ***C07C 9/04*** | (2006.01) |
| ***C07C 9/00*** | (2006.01) |
| ***C10L 3/00*** | (2006.01) |
| ***C10L 3/10*** | (2006.01) |

(52) U.S. Cl. ..... 210/406; 210/767; 210/741; 210/97; 210/105; 210/111; 585/15

(58) Field of Classification Search ..... 210/406, 210/767, 741, 97, 105, 111; 585/15
See application file for complete search history.

(56) References Cited

U.S. PATENT DOCUMENTS 8,043,579 B2 * 10/2011 Katoh et al. ..... 422/232
8,138,382 B2 * 3/2012 Kanda et al. ..... 585/15

FOREIGN PATENT DOCUMENTS

JP 2003-105362 A 4/2003
JP 2005-248124 A 9/2005

(Continued)

*Primary Examiner* — Thomas M Lithgow
(74) *Attorney, Agent, or Firm* — Jacobson Holman PLLC

(57) ABSTRACT

A gas hydrate slurry dewatering apparatus adapted to feed a raw as into a cylindrical main body of dewatering column so gas to attain pressuriation and so suction any gas from the interior of a drainage chamber disposed around the cylindrical main body so as to attain depressurization. An internal tube (8) as a constituent of a dewatering apparatus (6) in which the gas hydrate slurry (S) is introduced is provided with a separating section (7). A drainage chamber (10) is formed by the internal tube (8) and, disposed with a given spacing therefrom, an external tube (9). An exhaust blower (B2) and a drainage pump (P2) are connected to the drainage chamber (10). A gas feed blower (B3) for a raw gas (G1) is connected to the internal tube (8). A differential pressure detector (x1) is provided for detecting any pressure difference between the interior of the internal tube (8) and the interior of the drainage chamber (10). Control of the exhaust blower (B2) and/or the gas feed blower (B3) is performed by the signal from the differential pressure detector (x1).

2 Claims, 3 Drawing Sheets

FOREIGN PATENT DOCUMENTS

| | | | |
|---|---|---|---|
| JP | 2005-263675 | A | 9/2005 |
| JP | 2006-111769 | A | 4/2006 |
| JP | 2006-111785 | A | 4/2006 |
| JP | 2006-257359 | A | 9/2006 |

* cited by examiner

METHOD OF DEWATERING GAS HYDRATE AND APPARATUS THEREFOR

CROSS-REFERENCE TO RELATED APPLICATIONS

This is a national stage of PCT/JP08/055,487 filed Mar. 25, 2008 and published in Japanese, which has a priority of Japanese no. 2007-093991 filed Mar. 30, 2007, hereby incorporated by reference.

BACKGROUND OF THE INVENTION

1. Field of the Invention

The present invention relates to a dewatering apparatus for a gas hydrate slurry, and more specifically, to a dewatering apparatus in a production plant of gas hydrate in which a gas hydrate slurry is generated by being subjected to a hydration reaction of raw material gas such as methane or the like, and raw material water.

2. Description of Related Art

In recent years, natural gas which contains methane or the like as a major component has captured much of the spotlight as a clean energy source. Then, for purpose of transportation and storage, a practice of transforming such a natural gas into a liquified natural gas (hereinafter, referred to as LNG) is being conducted. Since, however, the transportation and storage of a gas in the form of a LNG requires maintaining it in a cryogenic state, not only a generation system but also a transportation system and a storage system have become quite expensive. As a consequence, they are limited to only large-scale gas fields, and were economically unfeasible for smaller-scale gas fields.

Under these circumstance, studies on manufacturing natural gas hydrate (hereinafter, simply referred to as gas hydrate) by causing natural gas to react with water, and transporting or storing it through the gas hydrate are being carried out. With regard to this gas hydrate, it is well known that the raw material gas and the raw material water are introduced into a reactor in which a predetermined temperature and pressure selected from among, for example, temperatures of 1 to 10° C. and atmospheric pressures of 30 to 100 atmosphere are retained, to generate a slurry which contains a crystalline-like gas hydrate. Then, this slurry is introduced into a dewatering apparatus to separate and remove unreacted water, and is subsequently again brought into contact with the raw material gas to manufacture a powdery gas hydrate having low water content.

In a production plant for such a gas hydrate, a horizontal screw press-type dewatering apparatus and a vertical gravity-type dewatering apparatus are proposed as a dewatering apparatus (e.g., Patent Document 1).

A horizontal screw press-type dewatering apparatus as described in such a Patent Document 1 is made of a double construction combined with a mesh-processed inner wall, and a cylindrical body constituting an outer shell situated at the outside of the inner wall, and it is configured such that a gas hydrate is drained from meshes processed on the inner wall by advancing the gas hydrate while forcedly squeezing it by a screw shaft mounted inside the inner wall.

In such a dewatering apparatus, the gas hydrate was consolidated and was adhered to the surface of a screw, during said process of dewatering said gas hydrate. As a result a load of the screw shaft was increased, and thus such a dewatering apparatus was required to be driven at a high torque.

Thus, in order to solve the problem with said dewatering apparatus, the present inventors have studied a dewatering apparatus in which the gas hydrate slurry is supplied into the cylindrical body by a slurry pump, and water is drained naturally from a porous portion of the cylindrical body while causing it to move up in succession, through the use of a vertical-type dewatering apparatus having a separating section formed to be porous at an intermediate section of a cylindrical body (e.g., Patent Documents 2, 3).

The vertical-type dewatering apparatus as described in Patent Document 2, the present inventors previously proposed, includes a cylindrical main body with drain holes formed at substantially intermediate section, and a dewatering collecting section (drainage chamber) provided around said drain holes. Then, the gas hydrate slurry supplied to the dewatering apparatus is designed to be dewatered resulting from unreacted water being drained from said drain holes.

Further a vertical-type dewatering apparatus as described in Patent Document 3, the present inventors previously proposed, is configured such that a dewatering column is made of a double cylindrical construction consisting of two cylindrical bodies of an internal tube and an external tube, and dewatering filtration elements are provided on both side walls of the internal tube and external tube respectively, then the unreacted water is caused to outflow to the outside of the column through both the filtration elements provided on the internal tube and the external tube.

Incidentally, since a dewatering apparatus as described in said Patent Document 2 is configured such that water and hydrate are separated by the action of gravity, there was a problem of slow rates at which the unreacted water is drained from said drain holes. In addition, the dewatering column must be high enough to enhance dewatering efficiency, and thus there was a problem with the increase in size of the apparatus.

A dewatering column as described in the other Patent Document 3 includes an annular-shaped bottom plate, an annular-shaped shielding plate, a gas hydrate-crushing device, and plural tabular blades provided in radial form at the lower end and so on, to form a complicated construction. Therefore, there was a problem that a period required to manufacture the dewatering column becomes longer, along with a higher cost.

Patent Document 1: Japanese Patent Application Kokai Publication No. 2003-105362

Patent Document 2: Japanese Patent Application Kokai Publication No. 2006-111769

Patent Document 3: Japanese Patent Application Kokai Publication No. 2006-257359

BRIEF SUMMARY OF THE INVENTION

Thus, the present inventors, in view of the problems in said Patent Documents 2 and 3, have sought to provide a dewatering column of a simple construction that restricts the height of a cylindrical main body of the dewatering column and improves a drainage capability in the middle part of a gas hydrate layer.

The present invention was made to solve the above-described conventional problems, and a dewatering method in a production plant of a gas hydrate according to the present invention is a method for dewatering unreacted water contained in a gas hydrate slurry generated through gas-liquid contact between raw material water and raw material gas, characterized in that an external tube is arranged around an internal tube of said dewatering apparatus to form a drainage section, and a pressure difference between said drainage section and a gas hydrate layer formed at an upper level above a separating section of said internal tube is generated by exhausting a gas of said drainage section and/or introducing a gas from the upper part of said internal tube.

Then, the dewatering apparatus in the production plant of the gas hydrate according to the present invention is an apparatus to dewater the unreacted water contained in the gas hydrate slurry purified through gas-liquid contact between the raw material water and the raw material gas, characterized in being configured such that an external tube is arranged around an internal tube of said dewatering apparatus to form a drainage section, and a pressure difference between said drainage section and the gas hydrate layer formed at the upper level above the separating section of said internal tube is generated by exhausting a gas in said drainage section and/or introducing a gas from an upper part of said internal tube.

EFFECT OF THE INVENTION

With a dewatering method for a gas hydrate according to the invention, a difference between a pressure inside a drainage chamber and a pressure inside an internal tube where the gas hydrate comes up is detected by a differential pressure detector, and the operation of an intake blower and/or a gas feed blower is controlled according to its signal. Therefore, a pressure difference between inside the drainage chamber and inside the internal tube can be retained at a predetermined value and its differential pressure can be increased, and as the unreacted water contained in the gas hydrate is squeezed from the drainage section, dewatering efficiency is improved.

With a dewatering apparatus of the gas hydrate according to the invention, a difference between a pressure inside the drainage chamber and a pressure inside an internal tube where the gas hydrate comes up is detected by a differential pressure detector, and the operation of an intake blower and/or gas a feed blower is controlled according to its signal. Therefore, a pressure difference between inside the drainage chamber and inside the internal tube can be retained at a predetermined value, and its differential pressure can be increased, and the unreacted water contained in the gas hydrate is squeezed and drained from the drainage section. As a result, a dewatering apparatus having good performance and in a small size can be provided.

LIST OF REFERENCE LETTERS

Figure 1:
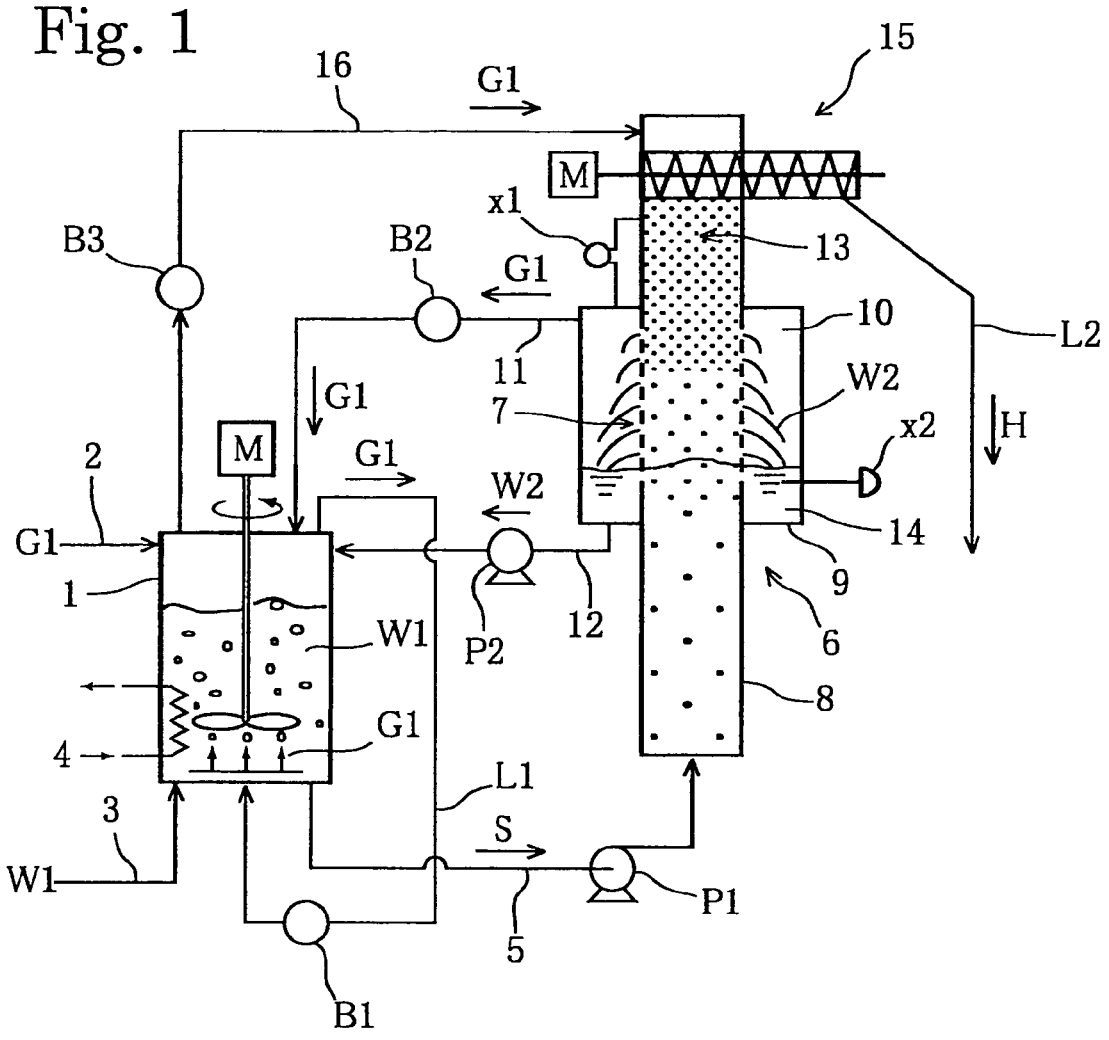
FIG. 1 is a schematic view of the first exemplary embodiment of a dewatering apparatus in a production plant of a gas hydrate according to the present invention.

1 reactor
2 gas supply line
3 water supply line
4 coolant
5 slurry line
6 dewatering apparatus
7 separating section
8 internal tube
9 external tube
10 drainage chamber
11 exhaust line
12 drainage line
13 hydrate layer
14 storage section
15 screw conveyor
16 gas supply line
17 first external tube
18 second external tube
19 partition wall
20 communicating chamber
B1 raw material gas supply blower
B2 exhaust blower
B3 gas feed blower
P1 slurry pump
P2 drainage pump
S slurry
G gas
W water
H gas hydrate
x1 differential pressure detector
x2 level gauge

DETAILED DESCRIPTION OF THE INVENTION

Hereinafter, exemplary embodiments of a dewatering apparatus in a production plant of a gas hydrate according to the present invention will be described with reference to FIG. 1 to FIG. 3.

Example 1

FIG. 1 is a schematic view for illustrating the first exemplary embodiment of a dewatering apparatus in a production plant of a gas hydrate according to the present invention. In FIG. 1, a reactor 1 is retained at predetermined pressure and temperature. A raw material gas G1 from a gas supply line 2 to the reactor 1, and raw material water W1 from a water supply line 3 are respectively introduced, wherein a gas hydrate slurry S is generated.

Then, the slurry S is supplied via a slurry line 5 having a slurry pump P1 to a dewatering apparatus 6, where being separated into unreacted water W2 and a gas hydrate H. To describe it in detail, the dewatering apparatus 6 is configured such that an internal tube 8 having a separating section 7 constituted by, for example, porous elements or the like, and an external tube 9 arranged to have a predetermined spacing from the internal tube 8 form a drainage chamber 10, one end of an exhaust gas line 11 having an exhaust blower B2 is connected to the upper part of said drainage chamber 10, one end of a drainage line 12 having a drainage pump P2 is connected to the lower part of said drainage chamber 10, then a differential pressure detector x1 for detecting a differential pressure between a pressure inside said internal tube 8 and a pressure inside said drainage chamber 10 is provided, and thereby said exhaust blower B2 is controlled according to the signal from the differential pressure detector x1.

In addition, there is provided a supply line 16 for raw material gas connected to the upper part of a reactor where a gas hydrate slurry S is generated, as well as being connected to the upper end side of the internal tube 8, and a gas feed blower B3 is provided on the supply line 16, and configured to be controlled according to the signal from said differential pressure detector x1.

In such a configuration, a pressure in the internal tube 8 is maintained higher by a predetermined value of pressure than a pressure in the drainage chamber 10 by driving either one or both of the exhaust blower B2 and the gas feed blower B3 under the action of the differential pressure detector x1.

Then, when the gas hydrate slurry S generated in said reactor 1 is introduced from the lower part of the internal tube 8 constituting the dewatering apparatus 6, the slurry S moves up in the internal tube 8 to reach a separating section 7, where the unreacted water W2 forming the slurry S is drained into the drainage chamber 10.

A gas hydrate H from which the unreacted water W2 has been drained moves further up in the internal tube 8, which forms a gas hydrate layer 13 at the upper side of the internal tube 8. At this moment, a part of the unreacted water W2 moves up to the lower part of the gas hydrate layer 13 (near the separating section 7) due to capillarity and it is likely to form a gas hydrate layer having a high water content. But, as a raw material gas G1 is introduced into the internal tube 8 and thus a pressure inside the internal tube 8 becomes higher than a pressure inside the drainage chamber 10, the unreacted water W2 is squeezed from the holes of the separating section 7, thereby to be drained into the drainage chamber 10.

The unreacted water W2 which has been drained into the drainage chamber 10 is sucked by a drainage pump P2, and returned via a drainage line 12 to the reactor 1. A level gauge x2 is equipped in said drainage chamber 10, and the drainage pump P2 is controlled according to the signal from the level gauge x2 such that a fluid level of the unreacted water W2 that has been drained into the drainage chamber 10 is controlled to be maintained at a predetermined position.

Then, the gas hydrate H which has been dewatered is supplied to equipment on the downstream side thereof by a screw conveyor 15 as a discharge device.

According to the present Example, a pressure inside the drainage chamber can be reduced lower than a pressure inside the internal tube 8 by sucking a gas in the drainage chamber 10 with the use of the exhaust blower B2, which enables to suck the unreacted water W2 contained in the slurry.

In addition, a raw material gas G1 is circulated by the gas feed blower B3 from the upper part of the internal tube 8 to the drainage chamber 10, and thus the raw material gas can be brought into countercurrent contact with the hydrate layer 13 and the unreacted water W2 can be purged and removed. In this case, it is enough to put the exhaust blower B2 at a standstill and to allow the raw material gas G1 to flow into a bypass line (not shown).

In the case of the dewatering process, a part of the unreacted water W2 is subjected to a hydration reaction so as to become hydrated through the contact with the raw material gas G1, which thus exerts effectiveness that the water content of the hydrate layer 13 can further be reduced. In addition, it is easy to control a pressure inside the internal tube 8 so as not to be lower than that inside a generator 1, whereby there is also no risk that the hydrate may be decomposed during the process of dewatering.

Further, a gas in the drainage chamber 10 may be sucked by the exhaust blower B2, while circulating the raw material gas G1 by the gas feed blower B3 from the upper part of the internal tube 8 to the drainage chamber 10. In that case, since the above-described effectiveness can be obtained at the same time, an excellent dewatering effectiveness can be obtained.

Example 2

Figure 2:
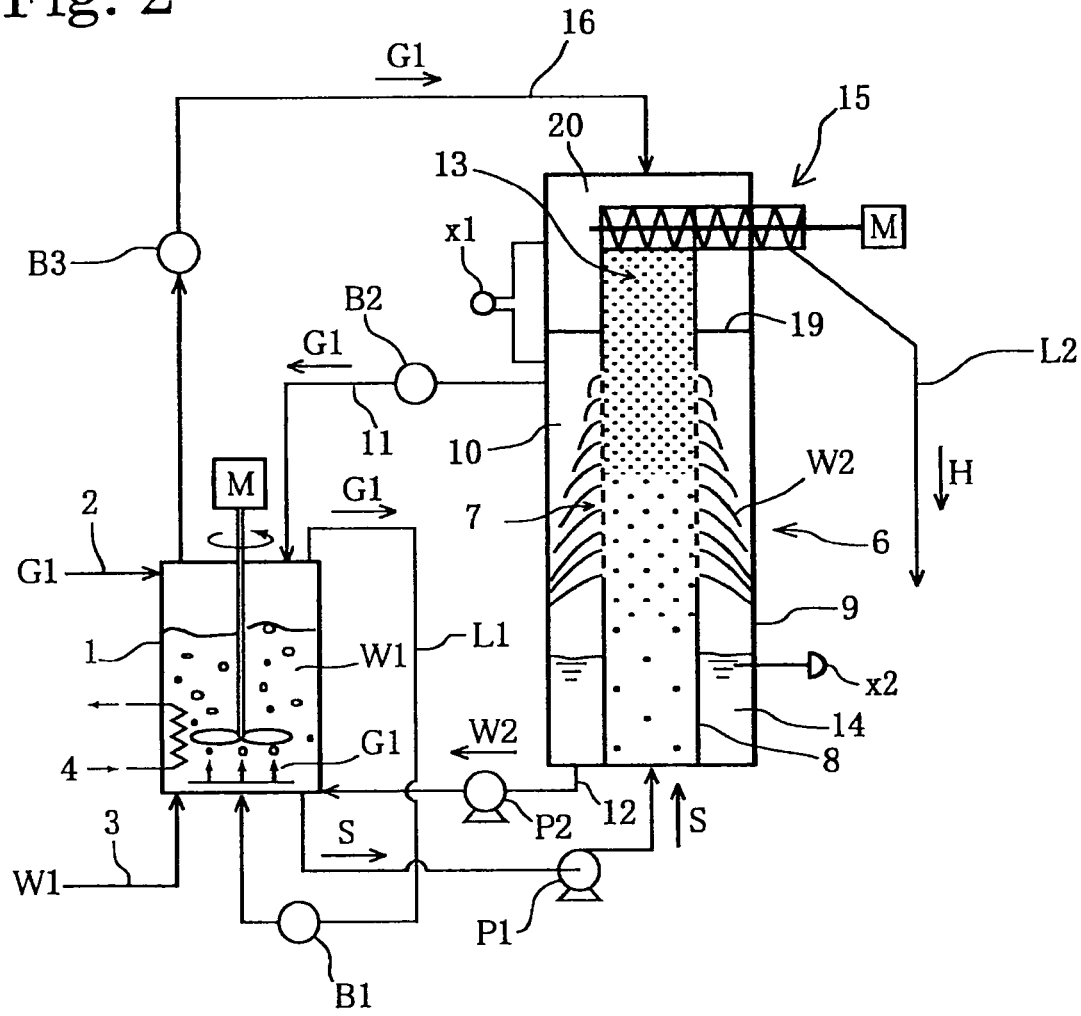
FIG. 2 is a schematic view of the second exemplary embodiment of a dewatering apparatus in a production plant of a gas hydrate according to the present invention.

FIG. 2 is a schematic view for illustrating the second exemplary embodiment of a dewatering apparatus of a gas hydrate according to the present invention, the same reference letters as those of FIG. 1 denote the same names, and their descriptions will be omitted.

In the FIG. 2, a dewatering apparatus 6 includes an internal tube 8 having a separating section 7, an external tube 9 arranged to have a predetermined spacing from the internal tube 8, and a partition wall 19 situated between the external tube 9 and the internal tube 8 and attached to the upper part of said separating section 7, wherein a communicating chamber 20 that communicates with an interior of the internal tube 8 over the partition wall 19 and a drainage chamber 10 below the communicating chamber 20 are formed.

A differential pressure detector x1 is designed to detect a differential pressure between inside the communicating chamber 20 and inside the drainage chamber 10 and to control the exhaust blower B2 and/or the gas feed blower B3.

A level gauge x2 is provided in said drainage chamber 10, and the drainage pump P2 is controlled according to the signal from the level gauge x2 such that a liquid level of the unreacted water W2 drained into the drainage chamber 10 is maintained at a predetermined position.

In the dewatering apparatus 6 configured in this way, a pressure inside the internal tube 8 is maintained higher by a predetermined value of pressure than a pressure inside the drainage chamber 10 by driving the gas feed blower B3, while being under the action of said differential pressure detector x1. Then, when a gas hydrate slurry S generated in said reactor 1 is introduced from the lower part of the internal tube 8 constituting the dewatering apparatus 6, the slurry S moves up in the internal tube 8 to reach the separating section 7, where the unreacted water W2 forming the slurry S is drained into the drainage chamber 10.

A gas hydrate H from which the unreacted water W2 has been drained moves further up in the internal tube 8, which forms a gas hydrate layer 13 at the upper side of the internal tube 8. At this moment, a part of the unreacted water W2 moves up to the lower part of the gas hydrate layer 13 (near the separating section 7) due to capillarity and it is likely to form a gas hydrate layer having a high water content. But, as a raw material gas G1 is introduced into the internal tube 8 and thus a pressure inside the internal tube 8 becomes higher than a pressure inside the drainage chamber 10, the unreacted water W2 is squeezed from the holes of the separating section 7, thereby to be drained into the drainage chamber 10.

The unreacted water W2 which has been drained into the drainage chamber 10 is sucked by a drainage pump P2, and is returned via a drainage line 12 to the reactor 1. A level gauge x2 is equipped in said drainage chamber 10, and the drainage pump P2 is controlled according to the signal from the level gauge x2 such that a fluid level of the unreacted water W2 that has been drained into the drainage chamber 10 is controlled to be maintained at a predetermined position.

Then, the gas hydrate H which has been dewatered is supplied to equipment on the downstream side thereof by a screw conveyor 15 as a discharge device.

According to the present Example, the dewatering apparatus 6 is made of a double tube construction with the drainage chamber 10 in the outer side and the internal tube 8 in the inner side, which has improved pressure resistance compared with a construction in which the external tube is provided in a part of the internal tube. Therefore, a pressure difference (differential pressure) between inside the drainage chamber 10 and inside the internal tube 8 can take a larger value by the activation of the exhaust blower B2 and/or the gas feed blower B3, and the unreacted water W2 of the slurry S can be drained more powerfully than the above-described Example.

Further, since a dewatering column is made of a double tube construction, the separating section 7 can be provided from the lower side to the upper side of the internal tube, and thus a dewatering performance of the slurry is improved. Therefore, the size of the dewatering apparatus can be made significantly smaller than that of the conventional vertical gravity-type dewatering apparatus.

In the present Example also, a gas contained in the drainage chamber 10 is sucked via an exhaust gas line 11, and the raw material gas G1 can be introduced into the internal tube 8 via the supply line 16. In addition, by sucking a gas contained in the drainage chamber 10 through the use of the exhaust blower B2, a pressure inside the drainage chamber 10 can be reduced lower than a pressure inside the internal tube 8, and the unreacted water W2 contained in the slurry can be also sucked.

Example 3

Figure 3:
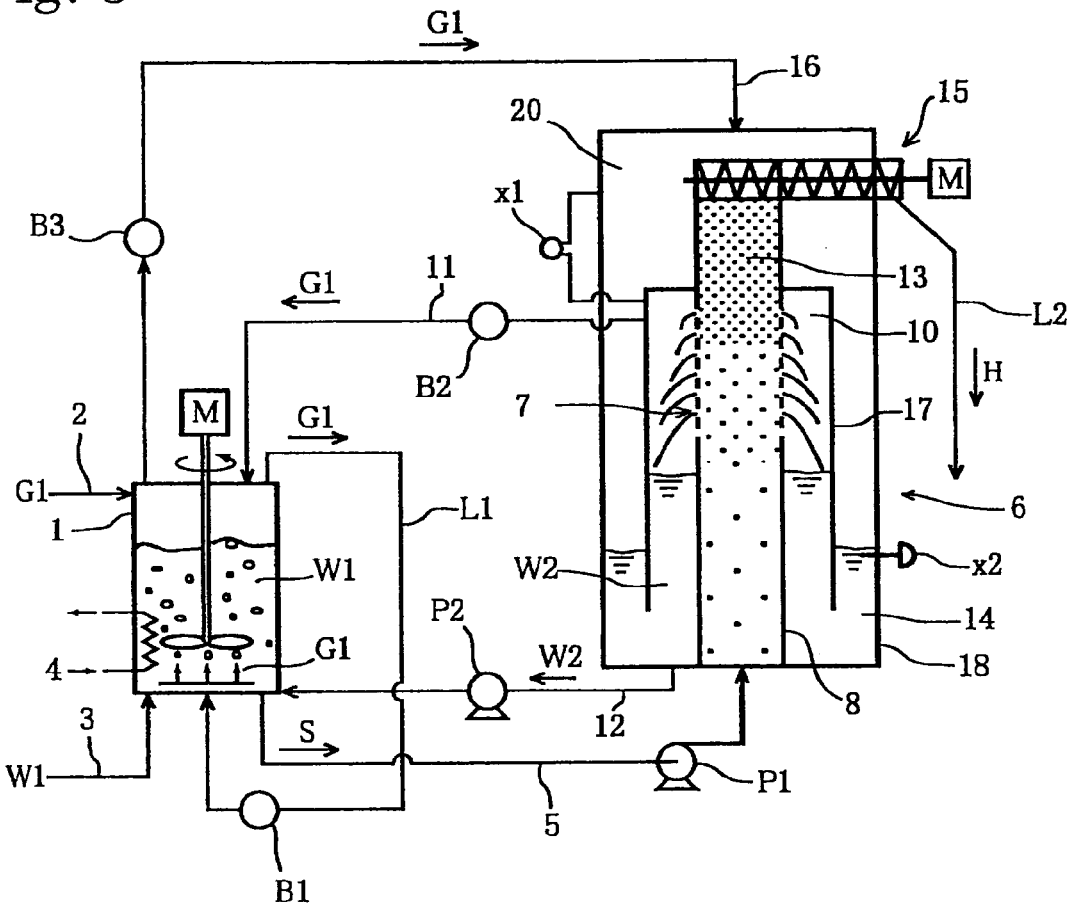
FIG. 3 is a schematic view of the third exemplary embodiment of a dewatering apparatus in a production plant of a gas hydrate according to the present invention.

FIG. 3 is a schematic view for illustrating the third exemplary embodiment of a dewatering apparatus of a gas hydrate according to the present invention. In the FIG. 3, the same reference letters as those in FIG. 1 and FIG. 2 denote the same names and their descriptions will be omitted.

In the FIG. 3, a first external tube 17 is a skirt-shaped partition wall in which the upper part is a periphery of an internal tube 8 and is attached to the upper part of a separating section 7, and the lower part is opened. The first external tube 17 and the internal tube 8 form a drainage chamber 10 and a communicating chamber 20 whose lower parts are opened. Difference between a pressure inside the communicating chamber 20 and a pressure inside the drainage chamber 10 is detected by a differential pressure detector x1, and an exhaust blower B2 and/or a gas feed blower B3 are controlled according to its signal.

In addition, an operation of a suction pump 14 is controlled by a level gauge 18 such that the lower end of the first external tube 17 may become lower than a fluid level of unreacted water W2 which has been drained from a slurry S. The inside of the first external tube 17 (drainage chamber 10) and that of the communicating chamber 20 are sealed by the unreacted water W2.

In the dewatering apparatus 6 configured in this way, a pressure inside a second external tube 18 is kept higher by a predetermined value of pressure than s pressure inside a first external tube 17 by driving the gas feed blower B3, while being under the action of said differential pressure detector x1. Then, when a gas hydrate slurry S generated in the reactor 1 is introduced from the lower part of the internal tube 8, the slurry S moves up in the internal tube 8 to reach the separating section 7, where the unreacted water W2 forming the slurry S is drained into the first external tube 17.

A gas hydrate H from which the unreacted water W2 has been drained moves further up in the internal tube 8, which forms a gas hydrate layer 13 at the upper side of the internal tube 8. At this moment, a part of the unreacted water W2 moves up to the lower part of the gas hydrate layer 13 (near the separating section 7) due to capillarity and it is likely to form a gas hydrate layer having high water content. But, as a raw material gas G1 is introduced into the internal tube 8 and thus a pressure inside the internal tube 8 becomes higher than a pressure inside a first external tube 17, the unreacted water W2 is squeezed from the holes of the separating section 7, thereby to be drained into the first external tube 17.

The unreacted water W2 drained into the first external tube 17 is sucked by a drainage pump P2 and returned via a drainage line 12 to a reactor 1. A level gauge x2 is provided on said first external tube 17, and the drainage pump P2 is controlled according to the signal from the level gauge x2 such that a fluid level of the unreacted water W2 that has been drained into the first external tube 17 is controlled to be maintained at a predetermined position.

Then, the gas hydrate H which has been dewatered is supplied to equipment on the downstream side thereof by a screw conveyor 15 as a discharge device.

In the exemplary embodiment, since it is designed to detect a difference between a pressure inside the communicating chamber 20 and a pressure inside the drainage chamber 10, a drainage pump P2 will be activated so as to attain a predetermined differential pressure that has been preset in a level gauge x2, for example, even if a pressure inside the internal tube 8 is changed by changing operation status. As a consequence, the apparatus can continue to operate without deterioration of a dewatering ratio or a dewatering speed or the like. In addition, if said differential pressure is changed, a fluid level of the unreacted water W2 that seals the interior of the drainage chamber 10 and that of the communicating chamber 20 is designed to be changed in water level depending on a magnitude of its differential pressure. Consequently, possible damages to the dewatering apparatus when sporadic pressure changes occur will be prevented.

What is claimed is:

1. Apparatus for dewatering unreacted water contained in a gas hydrate slurry generated through gas-liquid contact between raw material water and raw material gas, comprising:

an internal tube having a separating section and an upper part above the separating section for containing a gas hydrate layer formed therein, an external tube arranged around the internal tube to form a drainage section, a gas feed blower for feeding gas to the upper part of the internal tube, an exhaust blower connected to the drainage section for exhausting gas from the drainage section, wherein the exhaust blower in conjunction with the gas feed blower generates a pressure difference between the drainage section and a gas hydrate layer formed at the upper part of the internal tube above the separating section, and means for controlling operation of the exhaust blower and the gas feed blower in response to the pressure difference between the drainage section and the gas hydrate layer formed at the upper part of the internal tube above the separating section.

2. A method for dewatering unreacted water contained in a gas hydrate slurry generated through gas-liquid contact between raw material water and raw material gas, using the apparatus of claim 1, said method for dewatering a gas hydrate comprising the steps of:

feeding gas to the upper part of the internal tube using the gas feed blower and exhausting gas from the drainage section using the exhaust blower to generate a pressure difference between the drainage section and a gas hydrate layer formed at the upper part of the internal tube above the separating section, and controlling operation of the exhaust blower and the gas feed blower in response to the pressure difference generated between the drainage section and the gas hydrate layer formed at the upper part of the internal tube above the separating section.

* * * * *